US005551635A

United States Patent [19]

Jäger

[11] Patent Number: 5,551,635

[45] Date of Patent: Sep. 3, 1996

[54] ADJUSTABLE SPRAY NOZZLE FOR PRESSURE WASHER

[76] Inventor: Anton Jäger, Krautgartenweg 12, D-89250 Senden, Germany

[21] Appl. No.: 343,103

[22] Filed: Nov. 22, 1994

[30] Foreign Application Priority Data

Nov. 25, 1993 [DE] Germany ..... 43 40 184.8

[51] Int. Cl.[6] ..... B05B 3/04

[52] U.S. Cl. ..... 239/240; 239/264; 239/455; 239/481

[58] Field of Search ..... 239/237, 240, 239/241, 227, 251, 252, 263.3, 264, 470, 481, 590.3, 455

[56] References Cited

U.S. PATENT DOCUMENTS

| | | | |
|---|---|---|---|
| 4,228,956 | 10/1980 | Varner | 239/237 |
| 4,747,544 | 5/1988 | Kranzle | 239/251 |
| 4,989,786 | 2/1991 | Kranzle et al. | 239/240 |
| 5,217,166 | 6/1993 | Schulze et al. | 239/227 |
| 5,265,806 | 11/1993 | Ferrarini | 239/251 |
| 5,328,097 | 7/1994 | Wesch et al. | 239/243 X |
| 5,332,155 | 7/1994 | Jager | 239/237 |
| 5,395,053 | 3/1995 | Frech | 239/237 |

*Primary Examiner*—Andres Kashnikow

*Assistant Examiner*—Lisa Douglas

*Attorney, Agent, or Firm*—Herbert Dubno; Andrew Wilford

[57] ABSTRACT

A pressure-washer nozzle has an inner sleeve generally centered on and extending along an axis and having a rear end formed as a high-pressure liquid inlet, an outer sleeve coaxial with and rotatable but axially nondisplaceable on the inner sleeve, and a rear nozzle body in the inner sleeve formed with a small-diameter axially throughgoing central rear passage opening at a front face of the rear nozzle body. The rear nozzle body further forms with the outer sleeve an array of outer rear passages. A front nozzle body in the inner sleeve forward of the rear nozzle body has a large-diameter axially throughgoing front passage coaxial with the rear passage. The front body is formed with a rear face engageable flatly with the front face of the rear nozzle body and this front body is movable axially in the inner sleeve between a front position with the faces spaced axially apart and flow possible through the inner and outer passages to the front passage and a rear position with the faces engaging each other and flow through the outer passages blocked. The outer sleeve is coupled with the front nozzle body to displace the front nozzle body axially relative to the rear nozzle body between its positions on rotation of the outer sleeve relative to the inner sleeve. A diverter can be mounted between the nozzle bodies and a rear guide to provide selective rotary action if desired.

20 Claims, 3 Drawing Sheets

ADJUSTABLE SPRAY NOZZLE FOR PRESSURE WASHER

FIELD OF THE INVENTION

The present invention relates to a nozzle for a spray washer. More particularly this invention concerns such a nozzle which allows the spray pattern to be adjusted.

BACKGROUND OF THE INVENTION

There are basically two types of nozzles for pressure washers. The standard kind constitutes a flow restriction so that the high-pressure wash liquid emerges from the nozzle as a unitary solid stream. In the rotor type described in my application 08/037,616 of 25 Mar. 1993 now U.S. Pat. No. 5,332,155 a diverter in the nozzle deflects the stream about an axis so that the device is particularly effective when used at very high pressure against very stubborn dirt or the like.

The main problem with these systems is that the user must select which type of nozzle he or she wants, and then mount it on the spray wand. Once a certain type of nozzle is mounted there is occasionally some spray adjustment, but it is rudimentary at best and offers only a modest variation of the spray or flow pattern.

OBJECTS OF THE INVENTION

It is therefore an object of the present invention to provide an improved nozzle for a pressure washer.

Another object is the provision of such an improved nozzle for a pressure washer which overcomes the above-given disadvantages, that is which is highly adjustable.

A further object is to provide a pressure-washer nozzle which can be set for rotary or nonrotary action, and that is fully adjustable in either operational mode.

SUMMARY OF THE INVENTION

A pressure-washer nozzle has according to the invention an inner sleeve generally centered on and extending along an axis and having a rear end formed as a high-pressure liquid inlet, an outer sleeve coaxial with and rotatable but axially nondisplaceable on the inner sleeve, and a rear nozzle body in the inner sleeve formed with a small-diameter axially throughgoing central rear passage opening at a front face of the rear nozzle body. The rear nozzle body further forms with the outer sleeve an array of outer rear passages. A front nozzle body in the inner sleeve forward of the rear nozzle body has a large-diameter axially throughgoing front passage coaxial with the rear passage. The front body is formed with a rear face engageable flatly with the front face of the rear nozzle body and this front body is movable axially in the inner sleeve between a front position with the faces spaced axially apart and flow possible through the inner and outer passages to the front passage and a rear position with the faces engaging each other and flow through the outer passages blocked. The outer sleeve is coupled with the front nozzle body to displace the front nozzle body axially relative to the rear nozzle body between its positions on rotation of the outer sleeve relative to the inner sleeve.

Thus with this embodiment of the invention for low-pressure use the front body is spaced forward of the rear body and flow is through all of the passages. For medium- or high-pressure use the front body is pushed back to block the peripheral passages so all flow is through the central small-diameter passage. As the front body is moved back it throttles flow from the peripheral passages, ensuring a smooth transition from low-pressure to high-pressure action.

In accordance with a further feature of this invention the rear nozzle body may be integral with the front one and formed with a rearwardly open front seat. The rear nozzle body further includes a tubular diverter forming the small-diameter passage and having a front end engaged in the seat and a rear end orbitable about the axis in the inner sleeve. The nozzle further has according to the invention a rear guide formed with a forwardly flared seat receiving the rear end of the diverter so that as the rear nozzle body moves axially rearward the rear end is pushed into the forwardly flared seat to limit its orbiting. The guide is formed with a tangentially open inlet opening exposed at the inlet so that liquid entering the guide via the inlet opening swirls in the inner sleeve to orbit the diverter therein.

With this system, therefore, it is possible to switch between rotary and nonrotary action. As the nozzle body is pushed back the rear end of the diverter will ride up in the guide to limit the radius of its orbiting, and the spray pattern will get tighter until when the diverter is wedged into the guide and cannot orbit at all, whereupon nonrotary action is obtained. This system can be combined with a two-piece nozzle body as described above to obtain a steady progression from low-pressure rotary action to high-pressure nonrotary action.

The inner sleeve according to the invention is formed with a relatively large-diameter passage in which the valve bodies are axially displaceable. The diverter has an outside diameter greatly smaller than a diameter of the inner-sleeve passage. Cam formations on a shoulder of the outer sleeve are used to axially move the nozzle body. Furthermore a pair of focussing plates in the outer-sleeve passage axially forward of the front nozzle body flank the axis. They can be displaced toward and away from each other to change spray pattern on rotation of the outer sleeve on the inner sleeve. An annular element engaging the coupler bears axially backward on the front valve element and the focussing plates are axially fixed in the annular element. The plates are displaced by formations on the outer sleeve. In addition the front nozzle body is formed with a forwardly pro- jecting annular collar fitted in the annular element and the outer sleeve is formed internally with an axially rearwardly directed shoulder against which the rear nozzle body is forwardly engageable.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
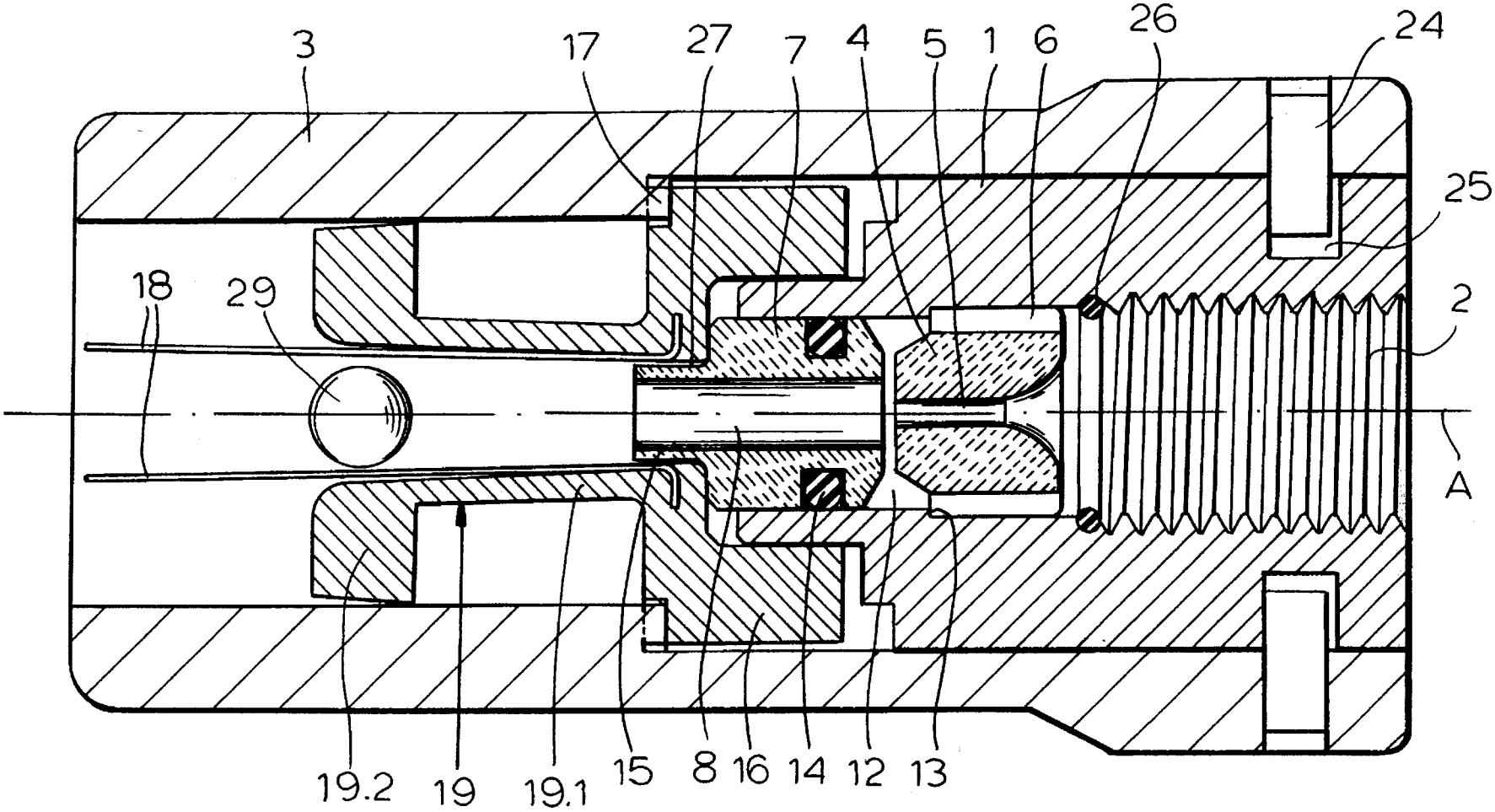
FIG. 1 is a partly diagrammatic axial section through an adjustable power-washer nozzle according to the invention.

As seen in FIG. 1 a pressure-washer nozzle according to this invention has a nozzle body or inner sleeve 1 centered on an axis A and formed along this axis A with a throughgoing bore or passage 12 having a threaded back inlet end 2 to which is fed liquid under high pressure. An outer adjustment sleeve 3 also centered on this axis A coaxially surrounds the sleeve 1 and is rotatable thereon but not axially displaceable thereon. Pins 24 seated in the outer sleeve 3 ride in a radially outwardly open groove 25 of the inner sleeve 1 to permit this rotation while inhibiting axial movement.

Axially shiftable in the passage 12 between a rearwardly directed shoulder 13 and a rear snap ring 26 is a short rear nozzle body 4 formed centrally on the axis A with a small-diameter rear passage 5 and formed peripherally with an array of angularly equispaced and radially outwardly open grooves forming a plurality of peripheral passages 6. Forward of this body 4 is a front nozzle body 7 here acting as a valve member and formed on the axis A with a large-diameter front passage 8. This body 7 can move axially in the passage 12 forward of the shoulder stop 13 and is provided with an O-ring 14 that seals between it and the inner surface of the passage 12. In the illustrated position flow is possible through the rear passage 5 and peripheral passages 6 to the bore 8. When pressed back with its rear end face bearing on the front face of the body 4, the body 7 blocks flow from the passages 6, only permitting flow through the central passage 5.

The body 7 is formed on its front end with a forwardly projecting tubular collar 15 that projects into a bore 27 of an adjustment member 16 and this body 7 has around this collar 15 a front face that engages axially forwardly against a rear face of this member 16. The member 16 is rotationally fixed on the inner sleeve 1 but axially displaceable relative to this inner sleeve 1. A contoured annular shoulder forming a cam 17 between the outer adjustment sleeve 3 and the adjustment body 16 translates rotation of the adjustment sleeve 3 on the body 1 into axial displacement of the body 16. Thus when the sleeve 3 is rotated on the sleeve 1 in one direction, the member 16 and body 7 are pushed back toward and against the body 4 and when oppositely rotated the parts 7 and 4 can move axially forward to the illustrated position.

A pair of guide plates 18 that symmetrically flank the axis A and that diverge somewhat forwardly have rear ends secured in the body 16. These plates 18 bear radially outward on respective clamp parts 19 that each are formed of a thin generally axially extending portion 19.1 and a forward foot 19.2 engaging the inner wall of the sleeve 3. Cam formations 8 in the sleeve 3 can displace the plates 18 radially inward and outward. Thus rotation of the sleeve 3 can not only focus the spray, but can also change it from a round to a fan shape. Springs 20 (see FIG. 3) can be provided to bias the plates 18 into the spread position.

Here as the sleeve 3 is rotated to push back the front body 7, the spray will increase in force. As the body 7 moves back it closes flow through the peripheral passages 6 so that all flow is directed through the central passage 5, making the spray more concentrated and forceful.

Figure 2:
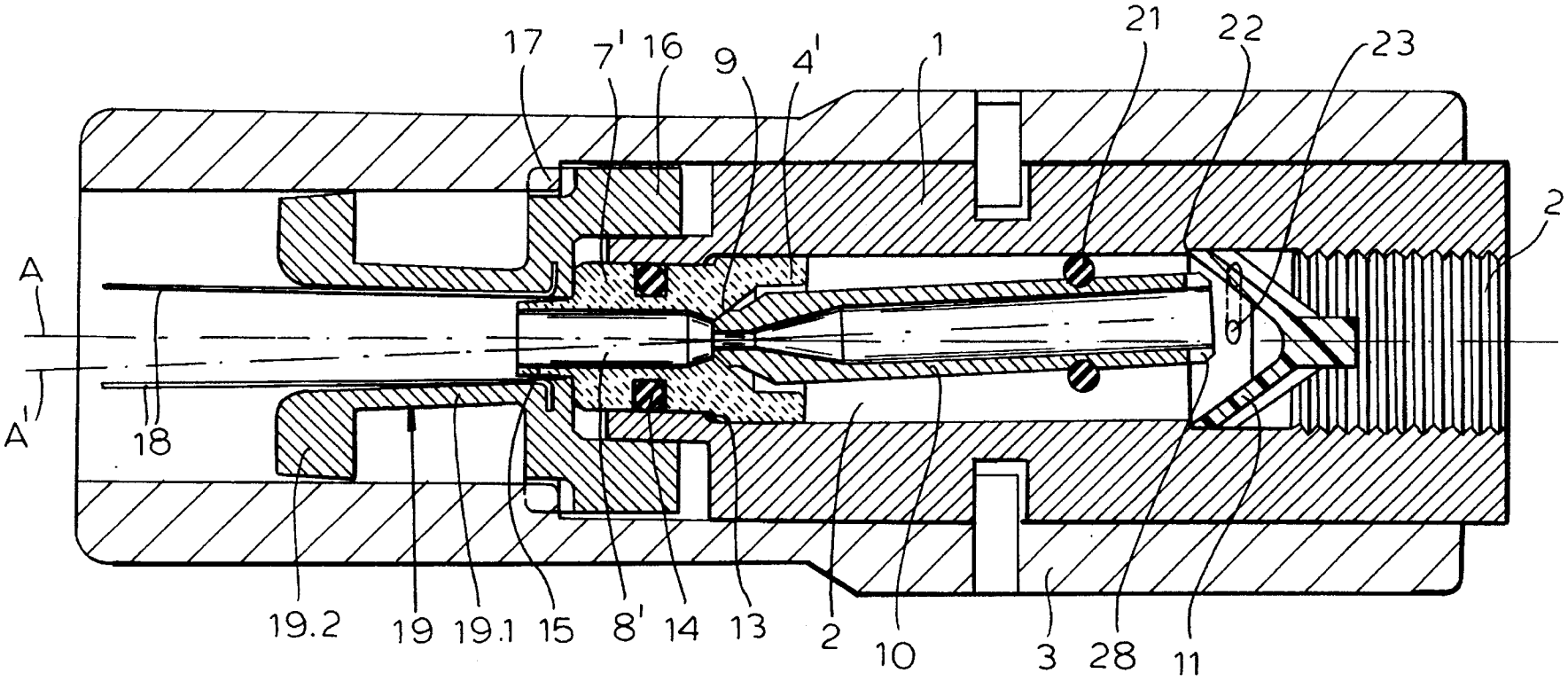
FIG. 2 is a view like FIG. 1 of another nozzle in accordance with this invention.

In the arrangement of FIG. 2 the bodies 4' and 7' are unitary with each other. The body 7' forms a rearwardly open frustoconical seat 9 in which sits the front end of a tubular diverter element 10 having a rear end provided with an elastomeric ring 21 by means of which it can roll on the inside surface of the bore 12. The bore 12 is formed with a small rearwardly directed shoulder 22 against which fits a forwardly flared frustoconical guide 11 in which the rear end of the diverter 10 can engage. Liquid flow from the inlet 2 passes through a tangential hole 23 in the guide 22 so that it swirls about the axis A in the passage 12. The diverter 10 is centered on an axis A' that normally forms a small acute angle with the nozzle axis A.

With this system the swirling water in the passage 12 will cause the rear end of the diverter 10 to orbit about in the passage 12. Since all flow through the element 4', 7' is through this diverter 10, the outgoing spray will therefore be in a round pulsating pattern. As the element 4', 7' is pushed axially back by the sleeve 13, the rear end of the diverter 10 will be increasingly confined by the guide 11 so that the diameter of the round pulsating spray will decrease. When all the way back the diverter 10 will be jammed tightly between the seat 9 and guide 11 so that it will not orbit at all and there will be no rotor action. The rear end of the diverter 10 is formed with notches 28 so that even in this fully back position liquid will flow into its rear end.

Figure 3:
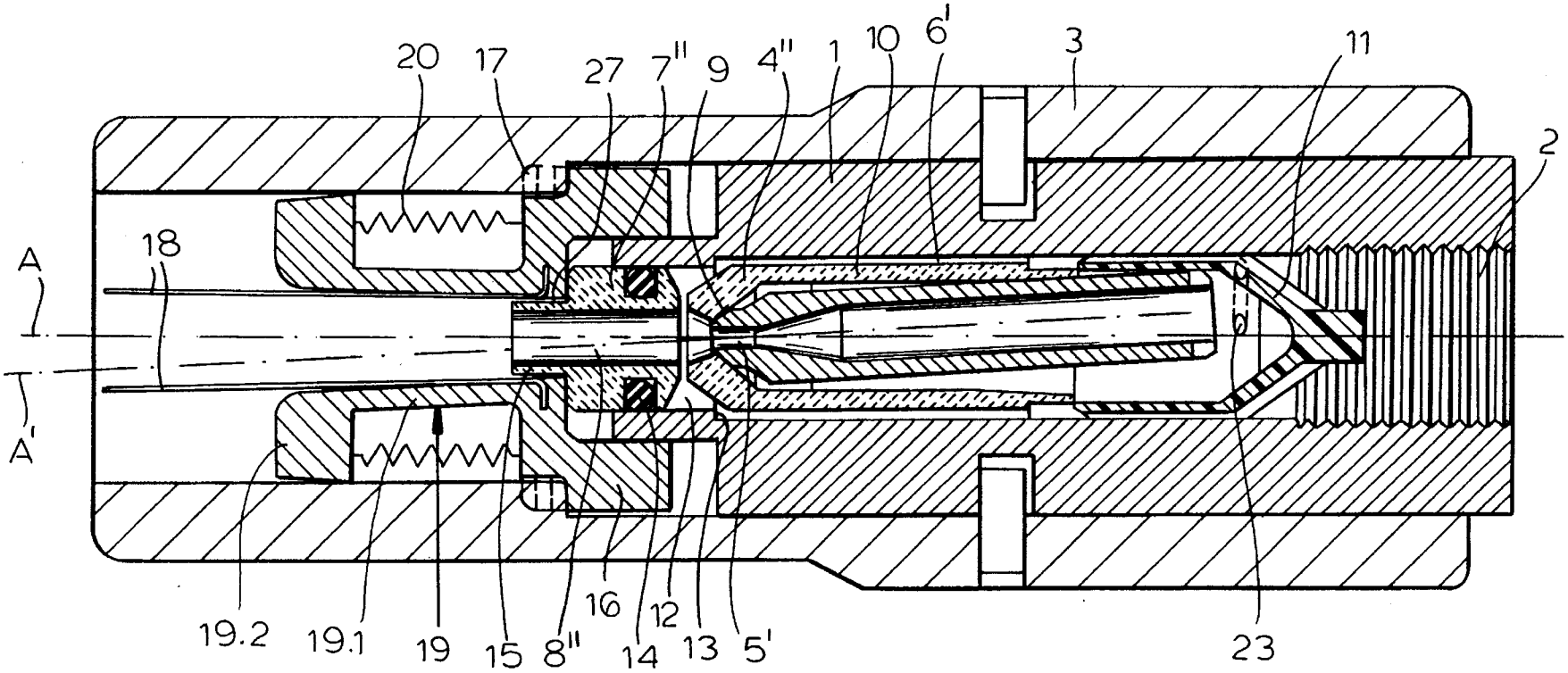
FIG. 3 is another view like FIG. 1 of a third nozzle according to the invention.

FIG. 3 shows a system that in effect is a combination of that of FIGS. 1 and 2. Here the valve bodies 4" and 7" are separate from each other, and the rear body 4" forms the seat 9 for the diverter 10. Here in the full-front position there is flow through the passages 5' (formed by the front end of the diverter 10) and 6' and the diverter 10 can swing through its widest radius, so the spray will be wide and soft. As the body 7" moves back the flow through the passages 6' is first stopped, making the spray considerably more concentrated and forceful, and as it moves back further the range of rotation of the diverter 10 is reduces to make the spray pattern more concentrated.

I claim:

1. A pressure-washer nozzle comprising:

an inner sleeve generally centered on and extending along an axis and having a rear end formed as a high-pressure liquid inlet;

an outer sleeve coaxial with and rotatable but axially nondisplaceable on the inner sleeve;

a rear nozzle body in the inner sleeve formed with a small-diameter axially throughgoing central rear passage opening at a front face of the rear nozzle body, the rear nozzle body further forming with the outer sleeve an array of outer rear passages;

a front nozzle body in the inner sleeve forward of the rear nozzle body and having a large-diameter axially throughgoing front passage coaxial with the rear passage, the front body being formed with a rear face engageable flatly with the front face of the rear nozzle body, the front body being movable axially in the inner sleeve between a front position with the faces spaced axially apart and flow possible through the inner and outer passages to the front passage and a rear position with the faces engaging each other and flow through the outer passages blocked; and means coupling the outer sleeve with the front nozzle body for displacing the front nozzle body axially relative to the rear nozzle body between its positions on rotation of the outer sleeve relative to the inner sleeve.

2. The pressure-washer nozzle defined in claim 1 wherein the coupling means includes cam formations on the outer sleeve.

3. The pressure-washer nozzle defined in claim 1, further comprising a pair of focussing plates in the outer-sleeve passage axially forward of the front nozzle body and flanking the axis; and means for displacing the plates toward and away from each other to change spray pattern on rotation of the outer sleeve on the inner sleeve.

4. The pressure-washer nozzle defined in claim 3, further comprising an annular element engaging the coupling means and bearing axially backward on the front valve element, the focussing plates being axially fixed in the annular element.

5. The pressure-washer nozzle defined in claim 4 wherein the means for displacing the plates includes formations on the outer sleeve.

6. The pressure-washer nozzle defined in claim 4 wherein the front nozzle body is formed with a forwardly projecting annular collar fitted in the annular element.

7. The pressure-washer nozzle defined in claim 1 wherein the outer sleeve is formed internally with an axially rearwardly directed shoulder against which the rear nozzle body is forwardly engageable.

8. The pressure-washer nozzle defined in claim 1 wherein the rear nozzle body is movable axially jointly with the front body and is formed as a rearwardly open front seat, the rear nozzle body including a tubular diverter forming the small-diameter passage and having a front end engaged in the seat and a rear end orbitable about the axis in the inner sleeve, the nozzle further comprising a rear guide formed with a forwardly flared seat receiving the rear end of the diverter, whereby as the rear nozzle body moves axially rearward the rear end is pushed into the forwardly flared seat to limit its orbiting.

9. The pressure-washer nozzle defined in claim 8 wherein the guide is formed with a tangentially open inlet opening exposed at the inlet, whereby liquid entering the guide via the inlet swirls in the inner sleeve to orbit the diverter therein.

10. The pressure-washer nozzle defined in claim 8 wherein the inner sleeve is formed with a relatively large-diameter passage in which the valve bodies are axially displaceable, the diverter having an outside diameter greatly smaller than a diameter of the inner-sleeve passage.

11. The pressure-washer nozzle defined in claim 1 wherein the inner sleeve is formed with a relatively large-diameter passage in which the valve bodies are axially displaceable, the front nozzle body being provided with a seal ring engaging the inner sleeve.

12. A pressure-washer nozzle comprising:

an inner sleeve generally centered on and extending along an axis and having a rear end formed as a high-pressure liquid inlet;

an outer sleeve coaxial with and rotatable but axially nondisplaceable on the inner sleeve;

a nozzle body axially displaceable in the inner sleeve formed with a large-diameter axially throughgoing central passage and forming a rearwardly flared front seat;

a tubular diverter formed with a throughgoing small-diameter passage and having a front end in the seat and a rear end;

a forwardly flared guide loosely receiving the diverter rear end, the diverter rear end being dimensioned such that it can orbit in the inner sleeve about the axis; and means coupling the outer sleeve with the nozzle body for displacing the nozzle body axially in the sleeves to press the diverter axially back into the guide.

13. The pressure-washer nozzle defined in claim 12 wherein the nozzle body is tubular and the diverter fits within the nozzle body.

14. The pressure-washer nozzle defined in claim 12 wherein the guide forms a frustoconically forwardly flared rear seat receiving the diverter rear end.

15. The pressure-washer nozzle defined in claim 14 wherein the guide is formed at the rear seat with a tangentially open inlet for liquid.

16. The pressure-washer nozzle defined in claim 14 wherein the rear end of the tubular diverter is formed with rearwardly open notches.

17. The pressure-washer nozzle defined in claim 12 wherein the nozzle body is formed of a front nozzle body axially movable in the inner sleeve and formed with the large-diameter passage and with a rear face and a rear nozzle body having a front face engageable with the front-body rear face and formed with a plurality of peripheral grooves forming with the inner sleeve respective outer passages, the rear nozzle body being movable between a front position with the faces spaced apart and a rear position with the faces sealingly engaging each other, the nozzle further comprising means coupling the outer sleeve with the front body for displacing the front body axially relative to the rear nozzle body between its positions on rotation of the outer sleeve relative to the inner sleeve.

18. The pressure-washer nozzle defined in claim 17 wherein the front body is sealed with respect to the inner sleeve.

19. The pressure-washer nozzle defined in claim 17 wherein the rear body and the guide can telescope axially in each other.

20. The pressure-washer nozzle defined in claim 17 wherein the diverter has an outside diameter that is substantially less than an inside diameter of the rear body.

* * * * *